US008139795B2

(12) United States Patent
Scheel et al.

(10) Patent No.: US 8,139,795 B2
(45) Date of Patent: Mar. 20, 2012

(54) LOUDSPEAKER SYSTEM FOR AIRCRAFT CABIN

(75) Inventors: Henning Scheel, Hamburg (DE); Frank Cordes, Stade (DE); Benjamin Grenzing, Hamburg (DE)

(73) Assignee: Airbus Deutschland GmbH, Hamburg (DE)

( * ) Notice: Subject to any disclaimer, the term of this patent is extended or adjusted under 35 U.S.C. 154(b) by 1194 days.

(21) Appl. No.: 11/871,186

(22) Filed: Oct. 12, 2007

(65) Prior Publication Data

US 2008/0089537 A1 Apr. 17, 2008

Related U.S. Application Data

(60) Provisional application No. 60/829,302, filed on Oct. 13, 2006.

(51) Int. Cl.

| | |
|---|---|
| ***H04R 25/00*** | (2006.01) |
| ***H04R 1/02*** | (2006.01) |
| ***H04R 1/00*** | (2006.01) |
| ***H04R 11/02*** | (2006.01) |
| ***H04R 9/06*** | (2006.01) |

(52) U.S. Cl. ..... 381/152; 381/150; 381/190; 381/191; 381/334; 381/386; 381/387; 381/389; 381/423; 381/426; 381/431

(58) Field of Classification Search ..... 381/150, 381/152, 334, 389, 423, 431, 190, 191, 386, 381/387, 426

See application file for complete search history.

(56) References Cited

U.S. PATENT DOCUMENTS

| | | | | |
|---|---|---|---|---|
| 4,284,168 | A * | 8/1981 | Gaus | 181/199 |
| 4,392,027 | A * | 7/1983 | Bock | 381/152 |
| 4,856,071 | A * | 8/1989 | Marquiss | 381/431 |
| 4,928,312 | A * | 5/1990 | Hill | 381/424 |
| 5,802,195 | A * | 9/1998 | Regan et al. | 381/190 |
| 6,215,884 | B1 * | 4/2001 | Parrella et al. | 381/190 |
| 6,320,967 | B1 * | 11/2001 | Azima et al. | 381/86 |
| 6,349,141 | B1 * | 2/2002 | Corsaro | 381/190 |
| 6,397,972 | B1 * | 6/2002 | Bank et al. | 181/148 |
| 6,404,896 | B1 * | 6/2002 | Yoo et al. | 381/401 |

(Continued)

FOREIGN PATENT DOCUMENTS

DE 2819615 A1 11/1979

(Continued)

OTHER PUBLICATIONS

German Examination Report dated Oct. 13, 2006.

*Primary Examiner* — Ida M Soward

(74) *Attorney, Agent, or Firm* — Perman & Green, LLP

(57) ABSTRACT

A loudspeaker system for an aircraft cabin for passengers has a support structure, which includes multiple flexible flat elements, forming the internal walls of the cabin, and fastening devices for fastening flat elements to the support structure, so that the flat elements may oscillate. At least one acoustic driver is connected to one or more flat elements, to induce a bending movement in the one or more flat elements. The particular flat element may oscillate as an acoustic diaphragm. The acoustic driver has a film-shaped piezoelectric exciter, which is bonded flatly to the flat element. The flat element bonded to an exciter has a first cover layer, a second cover layer, and a core layer between them. The core layer is subdivided in a plane parallel to the first and second cover layers by a horizontal incision in at least one predefined area.

8 Claims, 2 Drawing Sheets

U.S. PATENT DOCUMENTS

| | | | | |
|---|---|---|---|---|
| 6,438,242 | B1 * | 8/2002 | Howarth | 381/190 |
| 6,522,755 | B1 * | 2/2003 | Warnaka et al. | 381/86 |
| 6,744,904 | B2 * | 6/2004 | Kobayashi et al. | 381/396 |
| 6,819,769 | B1 * | 11/2004 | Zimmermann | 381/152 |
| 6,865,277 | B2 * | 3/2005 | Bank et al. | 381/152 |
| 7,038,356 | B2 * | 5/2006 | Athanas | 310/324 |
| 7,110,561 | B2 * | 9/2006 | Kam | 381/152 |
| 7,174,025 | B2 * | 2/2007 | Azima et al. | 381/152 |
| 7,391,879 | B2 * | 6/2008 | Beer et al. | 381/423 |
| 7,447,322 | B2 * | 11/2008 | Harris et al. | 381/152 |
| 7,480,392 | B2 * | 1/2009 | Shin et al. | 381/419 |
| RE40,860 | E * | 7/2009 | Billson et al. | 381/191 |
| 2002/0027999 | A1 | 3/2002 | Azima et al. | |
| 2002/0191808 | A1 * | 12/2002 | Croft et al. | 381/431 |
| 2003/0081800 | A1 * | 5/2003 | Klasco et al. | 381/152 |
| 2006/0140424 | A1 * | 6/2006 | Kobayashi | 381/190 |
| 2007/0053531 | A1 * | 3/2007 | Ohta et al. | 381/152 |

FOREIGN PATENT DOCUMENTS

| | | | |
|---|---|---|---|
| DE | 4335087 | A1 | 4/1994 |
| EP | 1351542 | A | 10/2003 |
| WO | 9717818 | A1 | 5/1997 |

* cited by examiner

LOUDSPEAKER SYSTEM FOR AIRCRAFT CABIN

CROSS-REFERENCE TO RELATED APPLICATIONS

This application is related to, claims the benefit of and priority to U.S. Provisional Patent Application Ser. No. 60/829,302 filed on 13 Oct. 2006.

BACKGROUND

1. Field

The present disclosed embodiments relate to a loudspeaker system for an aircraft cabin for passengers.

2. Brief Description of Related Developments

In current public address systems in aircraft cabins for reproducing speech announcements, conventional dynamic loudspeakers are used, which are installed in an overhead passenger service unit (PSU) or service duct. Because of the construction and the usually low diaphragm sizes, the loudspeakers develop a very strong directional effect in the medium and high-frequency ranges. This results in a significantly lower sound pressure level away from the preferred direction of the loudspeaker and thus an uneven sound pressure level distribution in the cabin. Outstanding sound and speech quality does result for the seats in the preferred direction of the conventional loudspeaker, but outside the main lobe, only adequate sound and speech quality results at best. In contrast, if the reproduction for the seats away from the preferred direction of the loudspeaker is good, it is perceived as very loud and annoying for the seats in the preferred direction of the loudspeaker, however.

The loudspeakers are safety-relevant and must have their full functional capability and generate the required sound pressure level and speech comprehensibility at a minimal power consumption for a defined time even in case of emergency.

A method and a configuration for achieving more uniform sound distribution properties in cabin loudspeaker operation of air and space vehicles is known from DE 28 19 615 A1. In the configurations, parts of the internal paneling, which is constructed as a honeycomb or sandwich, are provided with an acoustic drive, comprising magnet and oscillating coil, so that they assume the function of a loudspeaker diaphragm. Individual plates of the coffered ceiling and/or the side paneling of the passenger cabin are provided with a sound transducer at appropriate intervals in the cabin. In this prior art, the driver feeds out a force through a movement perpendicular to the main plane of the part, it pushing off against its intrinsic mass of the magnet (mass moment of inertia) or against a rigid retainer.

However, an actually optimal sound level distribution is not yet achieved in the cabin in this prior art either. The degree of freedom for positioning individual sound transducers is increased by using ceiling and side wall paneling elements, but this does not result in the desired effect of uniform sound pressure level distribution because of the partially interrupted sound transmission paths to the hearing location. Thus, for example, with a ceiling installation, the sound illumination is improved in the aisle areas, but this also results in shadowing effects of the baggage compartments located overhead for the seat positions. In the case of integration in side wall elements, a very high volume results through the near field irradiation of seats near the side wall, but a very low volume results due to the strong sound pressure level drop in the transverse direction. In two-aisle cabins, this results in significantly different sound pressures for window seats and middle aisle seats.

In addition, a piezo loudspeaker for improved audio systems in cabins for passengers is known from WO 97/17818. Multiple applications of piezocrystals are disclosed to produce flat loudspeakers of high quality. In particular, multiple flat loudspeaker constructions are specified, which are suitable for aircraft, inter alia.

An acoustic device having an active part is described in US 2002/0027999 A1, in which the distribution of the resonant modes is examined as a function of parameters of the active parts, including the geometric construction and the directionally-dependent rigidity.

SUMMARY

In one aspect, the disclosed embodiments equip the aircraft cabin with a loudspeaker system, in which the sound pressure level is essentially equal for all seats and in the aisle upon reproduction of speech and music signals, so that the various seat positions are acoustically irradiated approximately equally strongly. The speech comprehensibility and sound quality are to be very good for all seats during flight operation and also in emergency situations, independently of the signal conditioning and signal processing.

The disclosed embodiments are essentially based on using panels or panel elements of paneling or stowage elements above the head position (e.g., cover panels in the service duct, baggage compartments, light strip covers, or side wall paneling elements) as loudspeakers. A shaft above the passengers, which also contains individual ventilation, reading lights, signal lights, and oxygen boxes in addition to the loudspeakers in the prior art, is especially considered a service duct. According to one embodiment, the panel or panel element is provided with a piezoelectric oscillation exciter (film exciter), so that a panel loudspeaker is formed in this way. The piezoelectric film exciter is bonded flatly to the panel, i.e., laminated onto the panel or laminated into the panel, its back side also being covered by a layer. Structure-borne sound is induced in the panel by the oscillation exciter, which is radiated from the diaphragm panel as air-borne sound. The panel is constructed as multilayered (sandwich panel) and comprises two cover layers having a core layer (e.g., a honeycomb core), between them.

In particular in the event of multiple exciters on one flat element, one of multiple core layer areas situated adjacent to one another is assigned to each exciter, the multiple core layer areas being separated from one another. A subdivision of the panel into multiple areas more or less acoustically independent of one another is thus achieved. The individual acoustically active areas may be driven independently of one another due to the differently designed exciter elements on a flat element, and in this way a selective amplification of specific frequency ranges in the flat element is achievable.

In addition, in a preferred embodiment, the core layer (e.g., honeycomb structure) is subdivided at least in a predefined area in a plane parallel to the first and the second cover layers. The acoustic coupling between the first cover layer, on which the exciter is located, and the second cover layer, which is located on the interior of the aircraft cabin, is thus locally reduced in a targeted way. The sound pressure directly below the acoustic driver is thus reduced, so that it is distributed uniformly over a larger area overall. This measure results in the free and forced bending waves not being radiated exclusively, but rather the near field in the initiation point also acting as a punctual source due to its cophasal movement.

According to one embodiment, a loudspeaker system for an aircraft cabin for passengers is provided, said aircraft cabin having a support structure, which comprises: multiple flexible flat elements, which together form the internal walls of the cabin, fastening devices for fastening at least some of the flat elements to the support structure, so that the flat elements may oscillate per se, at least one acoustic driver which is connected to one or more flat elements, to induce a bending movement in the one or more flat elements, so that the particular flat element may oscillate as an acoustic diaphragm, the at least one acoustic driver comprising a film-shaped piezoelectric exciter, which is bonded flatly to the flat element. The loudspeaker system is characterized in that the flat element bonded to an exciter comprises a first cover layer, a second cover layer, and a core layer between them, and the core layer is subdivided in a plane parallel to the first and second cover layers by a horizontal incision in at least one predefined area.

In particular, the exciter is laminated onto the flat element. Alternatively, the exciter may also be laminated into the flat element, i.e., a further covering layer is located on its back side. The exciter is thus protected against mechanical strain and also against moisture and dirt, etc.

Multiple exciters, which preferably each have different geometrical dimensions, are preferably bonded to a flat element. Oscillations having various frequencies may thus be induced in the panel and therefore optimally cover different frequency ranges of the useful sound.

The properties of the cover layer may each be different, but are preferably identical. The core layer may both have a honeycomb structure and also comprise a foamed layer. Furthermore, the possibility of optimizing the core layer with different properties within a flat or partial flat element for the radiation and/or initiation of oscillations in specific frequency ranges also results from this approach. (E.g., various cell widths, core weight, core filling, etc.).

The acoustically active flat or partial flat elements are preferably integral components of paneling and/or stowage elements above the head position (e.g., service duct, baggage compartments). The typical loudspeaker systems may thus be replaced by the panel loudspeakers according to the present invention in the optimized approach.

The acoustically active flat elements are preferably an integral component of a service duct. The typical loudspeaker systems in the "head unit" may thus be replaced by the panel loudspeakers according to the present invention.

If the panel loudspeakers according to the present invention are used in combination with lighting components (e.g., in front of lighting elements in the "head unit"), the corresponding flat elements are transparent in particular.

The flat elements connected to acoustic drivers are preferably fastened to the support structure using vibration-damping retainers. By using retainers of this type (shock mounts), the acoustically active panels are decoupled from the support structure and the other paneling elements. This prevents uncontrolled propagation of the sound beyond the panel.

The flat elements bonded to the acoustic drivers are preferably provided with sound absorber elements on their edges. The vibration relay into neighboring panels is reduced or prevented by the vibration-inhibiting materials or designs in the edge areas of the flat elements.

One of the multiple advantages of the panel loudspeaker according to the present invention is that in its installed state, because of its uniform rapid distribution (multipoint source radiation), but above all because of the uneven phase distribution on the panel surface during radiation, undesired interference occurrences may be formed less well and therefore it has a directional characteristic on all sides which is uniform over all spatial angles.

BRIEF DESCRIPTION OF THE DRAWINGS

Further features and advantages of the disclosed embodiments result from the following description of preferred embodiments, in which reference is made to the attached drawings.

The illustration in the drawings is not to scale. Identical or identically acting elements are provided with the same reference numerals.

DESCRIPTION OF THE EMBODIMENTS

Figure 1:
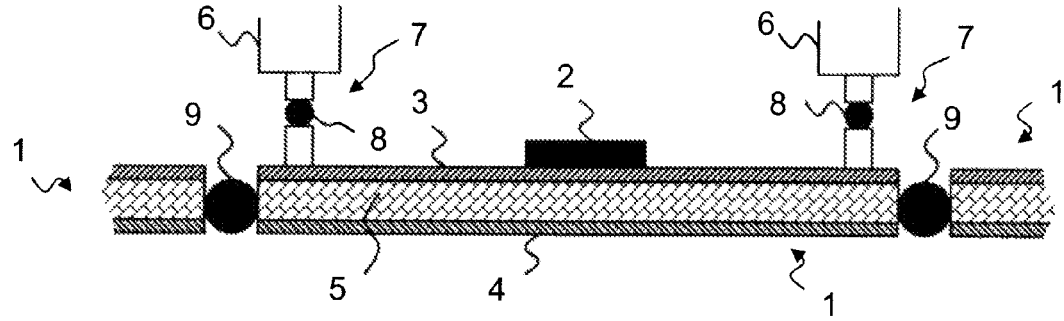
FIG. 1 shows a first embodiment of the panel having acoustic driver according to the present invention in cross-section.

Three panels are shown in FIG. 1, which are referred to in the following as flat elements 1. These flat elements 1 are part of the internal paneling of an aircraft cabin (not shown) for passengers, and thus form a part of the internal walls of the cabin. The aircraft cabin comprises a support structure 6, to which the flat elements 1 are attached. An acoustic driver 2, which excites the flat element 1 to oscillate, is attached to the flat elements 1 for sound generation. Specifically, the oscillation exciter induces bending movements in the flat element 1, so that the flat element radiates the induced (useful) structure-borne sound as airborne sound into the surroundings under specific boundary conditions as a bending wave transducer. The flat elements 1 are therefore designed in such a way that they fulfill the static requirements (e.g., hand loads) on one hand and also the acoustic conditions (e.g., rigidity, low weight per unit area, low internal damping) on the other hand.

At least some of the flat elements 1 are fastened to the support structure 6 using fastening devices 7, so that the flat elements 1 may oscillate per se. In addition, the flat elements may also be fastened to neighboring flat elements instead of directly to the support structure 6.

In the illustration in the drawing, the flat element 1 is a composite workpiece, which is assembled from multiple individual elements. In the embodiment shown, it is constructed as layered from a first cover layer 3, a second cover layer 4, and a core layer 5, preferably a honeycomb structure, between them. The cited layers are all glued and/or laminated to one another, as is typical to those skilled in the art in this field. The cover layer 3 is the top layer of the flat element 1 in the drawing. The piezoelectric exciter 2 is glued onto this top cover layer 3. The bottom cover layer 4 (visible side) is used for the actual sound delivery into the internal chamber of the cabin. The sound coupled into the top cover layer 3 is transmitted through the core layer 5 (honeycomb structure) to the bottom cover layer 4. The transmission efficiency is very significantly a function of the material properties and dimensions of both the cover layers and also the core layer (honeycomb structure) and the frequency.

To locally delimit the (desired) sound generation in the aircraft cabin and improve the effectiveness of the desired irradiation, the flat element 1 having the acoustic driver 2 is installed in a wall plane or partitioned by additional measures such as encapsulation or housing on the rear from the cabin interior. In this way, the re-radiation of the sound emitted at the rear is suppressed. Furthermore, vibration-reducing retainers 8 in the fastening devices 7—in the simplest case rubber or soft plastic elements between panel 1 and support structure 6—reduce the transmission of useful sound initiated in the panel to the support structure, to which the panels are fastened. In the illustration in the drawing, the retainer 8 is a small disk-like rubber damper, which in turn provides a safety stop against tearing out. In addition, sound absorber elements 9 are situated between the flat elements 1 and neighboring panel elements, which prevent a transmission of sound from the flat element 1 having acoustic driver to a flat element 1 without acoustic driver. The sound absorber elements 9 preferably have the form of a peripheral rubber or foam lip, but a minimal gap having an opening width less than 1 mm is also possible.

Figure 2:
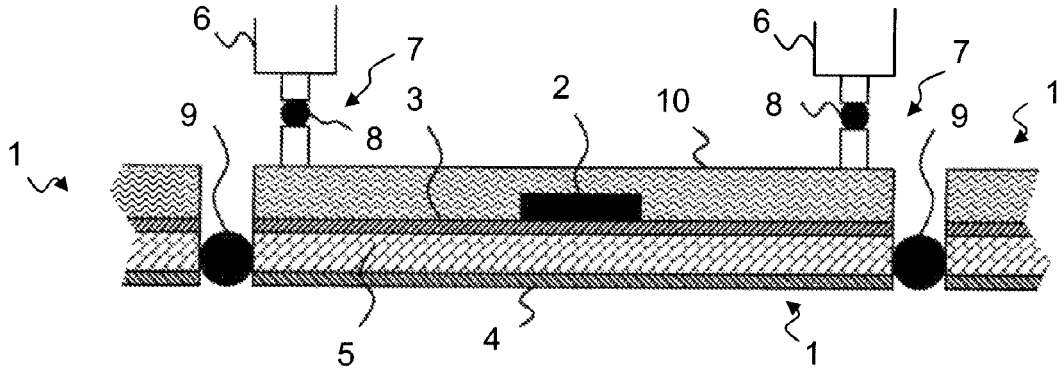
FIG. 2 shows a second embodiment of the panel having acoustic driver according to the present invention in cross-section.

FIG. 2 shows a further embodiment, which ensures greater protection of the acoustic driver 2 from mechanical strain such as moisture and dirt. For this purpose, a covering layer 10 is provided, which extends over the panel 1 having the driver 2 located thereon. In addition to the driver 2, its electrical supply lines are also laid in this layer 10. In other words, the driver 2 is laminated into the flat element 10. Direct and indirect influence by additional mass such as luggage, insulation or stiffening, and supports is not allowed here. Damage to the driver 2 and electrical cables by moisture and dirt, in particular during insulation or maintenance, is thus precluded.

Figure 3:
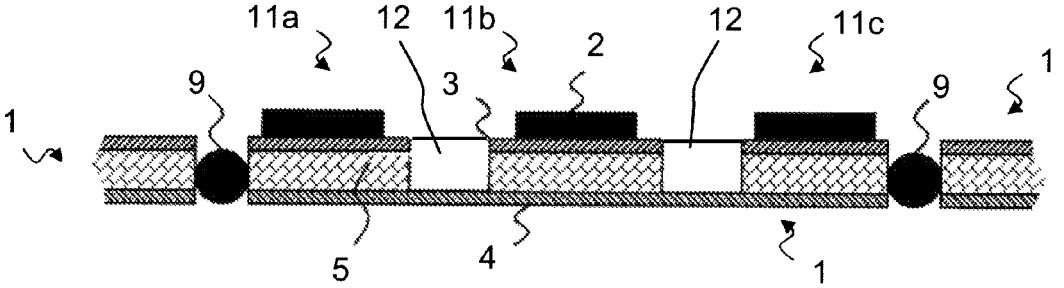
FIG. 3 shows a third embodiment of the panel having acoustic driver according to the present invention in cross-section.
Figure 4:
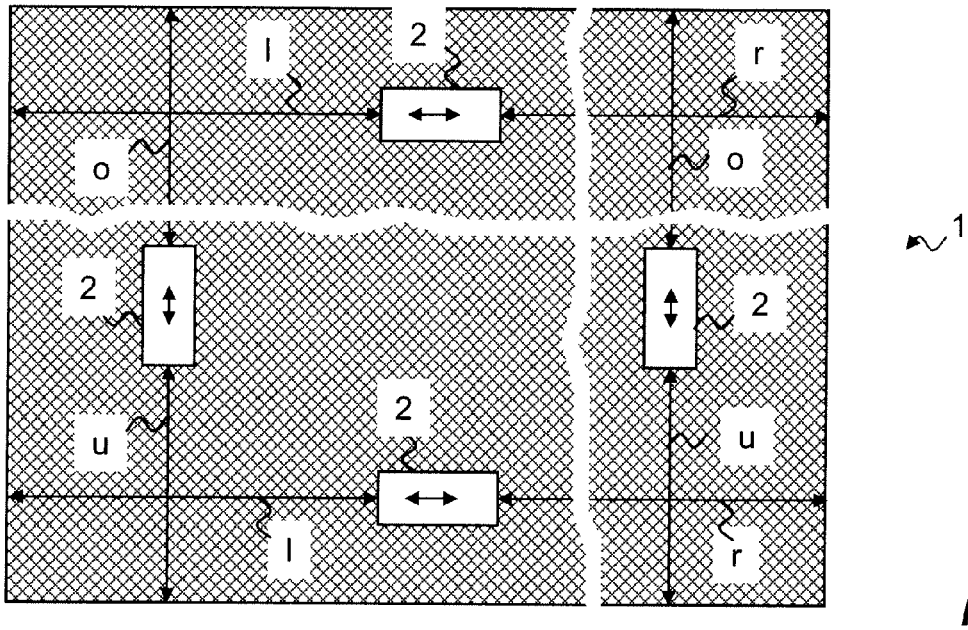
FIG. 4 shows a first embodiment of the configuration of the acoustic driver on a panel according to the present invention from above.

FIGS. 3 and 4 show a construction having multiple drivers 2 on a shared panel 1. According to the present invention, the acoustic driver 2 is a film-shaped piezoelectric exciter, which is bonded flatly to the flat element 1. This means that it is glued or laminated onto the largest area of the flat element 1.

A panel 1 having three exciters 2 is shown in cross-section in FIG. 3. Each exciter 2 is located on a section of the top cover layer 3, which is separated from a neighboring section of the cover layer 3. The honeycomb structure 5 may extend continuously over the entire flat element 1, or it may be interrupted at the same points as the top cover layer 3, as shown in FIG. 3. The bottom cover layer 4 is continuous over the entire flat element 1. In this way, multiple acoustically active areas 11*a*, 11*b*, 11*c* situated adjacent to one another are formed on one flat element 1, which are separated from one another by trenches or constrictions 12. These areas may be driven independently of one another and thus used for generating sound of various frequencies. Therefore, each exciter 2 on the flat element 1 is assigned to one of multiple honeycomb areas 11*a*, 11*b*, 11*c* situated adjacent to one another. The honeycomb areas 11 are separated from one another by constrictions 12 of the flat element 1 for more efficient acoustic decoupling.

In a further embodiment (not shown), perforated areas of the top cover layer 3 are provided instead of the constrictions 12. As in the illustration in FIG. 3, the vibration transmission between the areas 11*a*, 11*b*, and 11*c* is reduced by this measure, on the other hand the static carrying capacity of the entire panel 1 is improved.

FIG. 4 shows a construction having multiple exciters 2 per panel 1 in a top view. In this case, no acoustic interruptions 12 are provided between individual acoustic areas, instead the flat element 1 is constructed homogeneously. In the following, the location and orientation of the individual exciters 2 on the particular panels 1 are explained on the basis of this illustration.

The panels 1 may have an arbitrary size in principle. The panels used for sound generation preferably have dimensions in the magnitude of $15\times20$ cm$^2$ to $30\times60$ cm$^2$.

The exciters 2 comprise film-shaped piezoelectric crystals having dimensions in the magnitude of approximately $2\times5$ cm$^2$. They generally have an arbitrary shape which is a function of the desired active ranges. The crystals have a preferred direction along which they deform upon application of an electrical voltage, i.e., lengthen or shorten. A bending movement is thus obtained with two crystals glued onto one another having antiparallel polarization. The line along which the bending movement occurs is indicated in FIG. 4 by a double arrow of the exciter 2 in each case.

A preferred type of the configuration of exciters 2 on a flat element 1 comprises using two exciters in each case for a bending oscillation of the panel 1. For this purpose, a first exciter 2 is situated parallel to an edge of the panel 1 at a distance which is not too great, a second exciter 2 is also situated parallel to the diametrically opposite edge of the panel 1 at a distance which is not too great. This also applies for the second pair of edges. The particular exciter 2 is thus used for generating a bending oscillation of the panel 1 parallel to "its" edge. The two exciters 2 in FIG. 4, which are situated "horizontally", curve the panel 1 along a left leg "l" and a right leg "r"; the two exciters 2 in FIG. 4, which are situated "vertically", curve the panel 1 along a top leg "o" and a bottom leg "u". The movement sequence of a classical loudspeaker diaphragm may thus be simulated well, whose maximum deflection is in its middle, or precisely such a movement sequence may be avoided. The exciters 2 are each optimized in their size in relation to the sound frequency, i.e., they each preferably have different geometrical dimensions (not shown) on the one flat element 1.

Instead of the configuration in FIG. 4, the exciters 2 may also be placed in another geometric configuration (not shown) on the flat element. For example, a star-shaped configuration may be advantageous. In addition, the core layer may be partially interrupted, so that it is not broken down into individual segments. The oscillation behavior of the flat element 1 is thus altered in its sound irradiation and the shear modulus of the core layer is reduced in a targeted way in a desired direction, while it is left constant in the particular other direction. Therefore, different propagation velocities of the bending waves result and the particular propagation directions result from the various shear moduli, and also the composition of the modal behavior, which in turn has an effect on the sound radiation of individual frequency ranges. The frequency response may be set in this way.

Figure 5A:
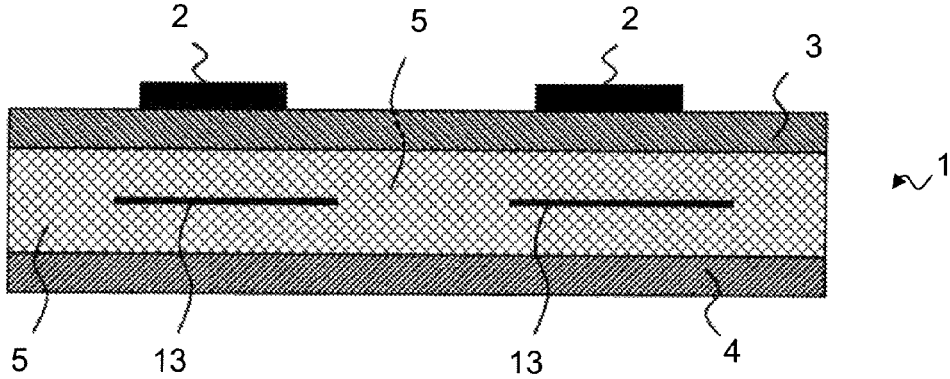
FIGS. 5A and 5B show an embodiment of the panel according to the present invention in the active and inactive states in cross-section.
Figure 5B:
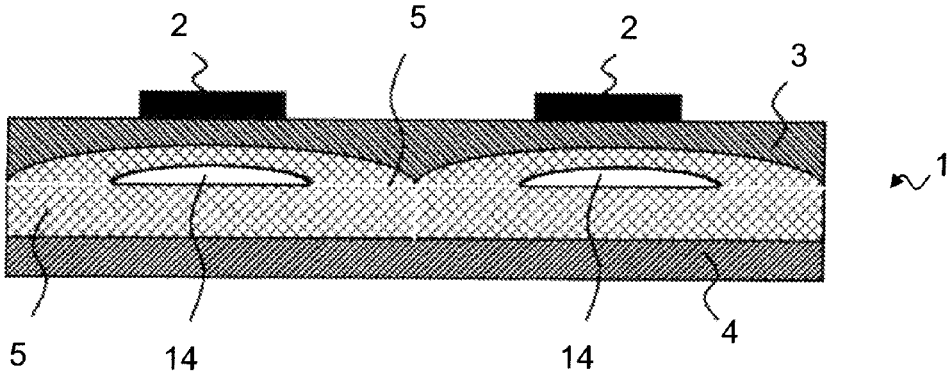

A further embodiment is shown in FIGS. 5A and 5B. It differs from the above embodiment in that the honeycomb structure is subdivided at least in a predefined area in a plane parallel to the first and second cover layers 3 and 4 by a partial horizontal slit or incision 13. A panel 1 having two exciters 2 is shown in FIG. 5A. The acoustic coupling between the first cover layer 3, on which the exciter 2 is located, and the second cover layer 4, which is located on the interior of the aircraft cabin, is thus locally worsened in a targeted way. The localization of the excitation point directly below the acoustic driver is thus reduced, so that it is perceived as distributed uniformly over a larger area overall.

The effect of the horizontal incision 13 in the honeycomb structure 5 is explained on the basis of FIG. 5B. When the exciter 2 induces a bending movement in the panel 1, with a horizontal incision 13, this has the result that only the area above the incision 13 curves in the way predefined by the exciter 2. The bottom area does not follow this movement or only follows it in a restricted way. A cavity 14 is thus formed in the honeycomb structure, which is shown in FIG. 5B. When the exciter 2 bends in the opposite direction, a pressure is exerted on the bottom part of the honeycomb structure below the incision 13, which in turn results in deflection of the bottom cover layer 4 into the cabin chamber. The movement of the bottom cover layer 4 upward remains damped, in contrast. Overall, a reduction of the sound pressure directly below the exciter thus results, the sound output is instead distributed over a larger area of the panel 1.

In general, the disclosed embodiments may be applied to all flat elements 1 which form a part of the internal paneling of the passenger cabin of a vehicle. In an aircraft cabin, the acoustically active flat elements 1 are preferably an integral component of a service duct directly above the seat rows of the passengers. If lighting devices are to be provided there, the flat elements 1 may be implemented as transparent. More efficient use of the installation space is thus possible.

Overall, the panel diaphragm according to the disclosed embodiments may thus be used as an integral component (cover panel) of the service duct and thus as a replacement for conventional dynamic loudspeakers. It allows a closed design of the service duct, without the duct having to be interrupted by loudspeaker grills. The installation space may be used more efficiently and/or reduced, because the particular panel may be produced from translucent panel material to integrate individual lighting and/or background lighting. Because of additional measures such as an additional covering layer, the acoustically active panel may also be made statically loadable up to 90 kg. In addition to fixing on rail systems in the service duct, vibration-insulating or vibration-damping retention (shock mounts) may be ensured by the suggested suspension of the panels.

In the preceding description, it was assumed that the flat element essentially corresponds to one panel. This does not always have to be so, however, rather a flat element may correspond to a delimited part of a panel, so that it forms a partial flat element. Both cases are to be covered by the attached claims.

Furthermore, the disclosed embodiments are not restricted to the use of the supply shaft. The above explanations also apply for baggage compartments.

LIST OF REFERENCE NUMERALS

1 flat element
2 acoustic driver, film-shaped piezoelectric exciter
3 first cover layer
4 second cover layer
5 honeycomb structure
6 support structure
7 fastening devices between flat element and support structure
8 vibration-insulating retention
9 sound absorber element between neighboring flat elements
10 further covering layer
11 acoustically active areas 11*a*, 11*b*, 11*c* situated adjacent to one another
12 constrictions between acoustically active areas
13 horizontal section in honeycomb structure
14 cavity in honeycomb structure
l left leg of the bending movement
r right leg of the bending movement
o top leg of the bending movement
u bottom leg of the bending movement

The invention claimed is:

1. A loudspeaker system for an aircraft cabin for passengers, having a support structure, which comprises:

multiple flexible flat elements, which together form the internal walls of the cabin, fastening devices for fastening at least some of the flat elements to the support structure, so that the flat elements may oscillate per se, at least one acoustic driver which is connected to one or more flat elements, to induce a bending movement in the one or more flat elements, so that the particular flat element may oscillate as an acoustic diaphragm, the at least one acoustic driver comprising a film-shaped piezoelectric exciter, which is bonded flatly to the flat element, wherein the flat element bonded to an exciter comprises a first cover layer, a second cover layer, and a core layer between them, and the core layer is subdivided in a plane parallel to the first and second cover layers by a horizontal incision in at least one predefined area, wherein the exciter is laminated into the flat element and a further covering layer is located on its rear side.

2. The loudspeaker system according to claim 1, wherein multiple exciters are bonded to a flat element, which each preferably have different geometrical dimensions.

3. The loudspeaker system according to claim 2, wherein each exciter on the flat element is assigned to one of multiple core layer areas situated adjacent to one another, the multiple core layer areas being separated from one another.

4. The loudspeaker system according to claim 3, wherein constrictions of the flat elements are provided for more efficient decoupling of the acoustically active areas from one another.

5. The loudspeaker system according to claim 1, wherein the acoustically active flat elements are an integral component of a service duct.

6. The loudspeaker system according to claim 1, wherein the flat elements bonded to acoustic drivers are fastened to the support structure using vibration-insulating retainers.

7. The loudspeaker system according to claim 1, wherein sound absorber elements are provided between the flat elements bonded to acoustic drivers and the flat elements neighboring them.

8. The loudspeaker system according to claim 1, wherein the exciter on the flat element is offset laterally to the horizontal incision in the core layer.

* * * * *